United States Patent [19]

Cambio, Jr.

[11] 4,113,129

[45] Sep. 12, 1978

[54] CONTAINER FOR STERILE LIQUIDS

[75] Inventor: Orlando D. Cambio, Jr., Bristol, Wis.

[73] Assignee: Respiratory Care, Inc., Arlington Heights, Ill.

[21] Appl. No.: 867,043

[22] Filed: Jan. 5, 1978

[51] Int. Cl.[2] ..... B65D 1/06

[52] U.S. Cl. ..... 215/1 C; 215/32; 150/0.5; 222/541

[58] Field of Search ..... 215/1 C, 32, 250, 247, 215/248, 249; 222/81, 89, 91, 541; 150/0.5

[56] References Cited

U.S. PATENT DOCUMENTS

| | | | |
|---|---|---|---|
| 3,156,383 | 11/1964 | Melli | 215/250 X |
| 3,325,031 | 6/1967 | Singier | 215/247 |
| 3,934,746 | 1/1976 | Lilja | 215/247 X |
| 3,951,145 | 4/1976 | Smith | 215/247 X |

*Primary Examiner*—Donald F. Norton
*Attorney, Agent, or Firm*—Eric P. Schellin

[57] ABSTRACT

A blow-molded thermoplastic container for storing and dispensing sterile liquids that is designed to be filled with a sterile liquid during the blow-molding having a first penetrably sealed threaded neck, a second penetrably sealed neck in an aperture near the base of the container and a plug designed to fit into the second neck after it has been penetrated. The plug is contained in a sealed depression in the wall of the container when not in use. The container also has an indented waist portion positioned in the approximate center thereof.

6 Claims, 4 Drawing Figures

CONTAINER FOR STERILE LIQUIDS

BACKGROUND OF THE INVENTION

Sterile medical liquids are dispensed in various medical procedures. One of the best known of these procedures is the administration of intravenous solutions. In this procedure a container is suspended above the patient and a liquid slowly drains into a tube into the patient's veins. Another well known system is the humidifier and mist therapy system in which the water used is provided from a container that is an integral part of the system.

It is of course critically important to keep the solutions sterile at all times. One method of assuring that the liquid remains sterile is to as least partially fill the container during the blow-molding process. There has been considerable activity in this field wherein the containers are blow-molded of a thermoplastic material such as polyethylene and polypropylene. The mode and operation and the apparatus for blow-molding and at least partially filling a thermoplastic container prior to integrally sealing is not part of this invention. These techniques and the apparatus are described in U.S. Pat. Nos. 3,325,860 and 3,851,029. The use of these containers insures sterility of the supply of water or other solution and provides a system that is immediately available 24 hours a day. The containers are easily transportable and can be conveniently stored in available work areas. Use of these containers affords maximum protection for the patient and the therapist against the chance of infection in the hospital.

SUMMARY OF THE INVENTION

The instant invention relates to a blow-molded thermoplastic container for storing and dispensing sterile liquids, the container is designed to be filled during the blow-molding operation. The essential features of the container are the penetrably sealed threaded neck that enables the therapist to attach a sterile threaded member to the container while simultaneously piercing the penetrable seal on the neck. The container is provided at its lower portion with a second neck with a penetrably sealed closure. A plug for this second neck is positioned in a depression in the wall of the container when not in use.

When the container is connected to an intravenous or other system sterile air can be admitted into the container by inserting a spike or puncture pin connected to a source of sterile air into the bottle through the second neck. If desired, the same can be removed and the aperture plugged with the plug positioned in the depression in the wall of the container.

DETAILED DESCRIPTION OF THE INVENTION

Figure 1:
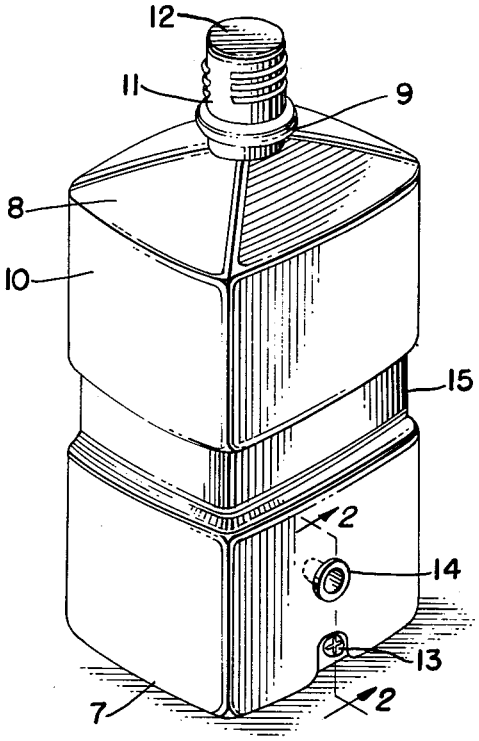
FIG. 1 is a front elevation view of the container as it is shipped, stored and ready for use.

In FIG. 1 the container is shown to include a body portion 10 having a base portion 7 and a top portion 8. The top portion terminates in an elongated upwardly extended threaded first neck closed by a penetrable seal 12 which is contiguous with the neck and is formed during the blow-molding operation.

A second relatively short neck 17 extends outwardly from the body 10 near the base portion 7. This neck also terminates in a penetrable seal that is contiguous with the second neck and is formed during the blow-molding operation. It is critically important that the sealed portion of this neck is substantially flush with the body.

A cap 14 is positioned in a depression in the body 10 in a manner such that it does not protrude substantially beyond the body but can be easily removed therefrom.

Figure 2:
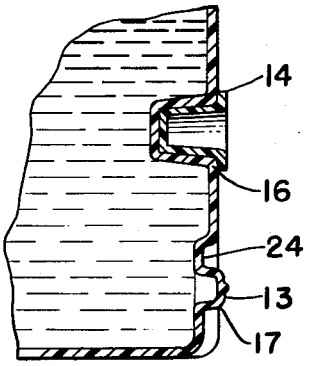
FIG. 2 is an enlarged sectional view taken through the line 2—2 of FIG. 1.

Referring now to FIG. 2 showing the details of the sealed indentation 16 in the wall of the container with the plug 14 inserted therein and the details of the second neck 17 with the penetrable section 13. This neck 17 and the penetrable section 13 are protected during storage and handling by a depressed area 24 surrounding the neck so that the neck does not extend beyond the edge of the container 10.

Figure 3:
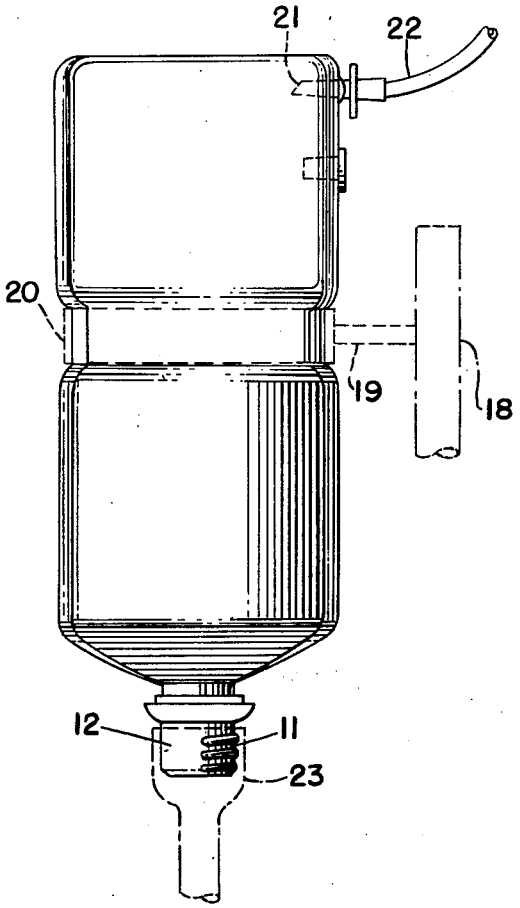
FIG. 3 shows the method of using the container with the threaded tube attached to the top of the container and a source of air being admitted to the bottom of the container while it is suspended in a conventional manner.

FIG. 3 shows a container 10 suspended on a support 18 and a rod 19 shown in dotted lines. The rod 19 is connected to an encircling member 20. A threaded tube member 23 is shown attached to the first threaded neck member 11. The threaded tube member 23 is sterile and equipped with a piercing means, not shown, for piercing the seal 12 on a threaded neck 11 of the container. A puncture pin 21 is shown inserted into the second neck member 13 and shown as attached to a tube 22 for supplying sterile air to the system.

Figure 4:
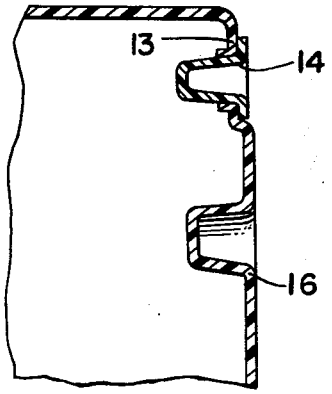
FIG. 4 shows the method of sealing the container by removing the cap from the position shown in FIG. 1 and placing it over the second neck.

Referring now to FIG. 4 which shows a plug 14 removed from the indented aperture 16 in the container 10 and placed in the second neck member 17 to provide a seal after the penetrable seal 13 has been broken by insertion of a puncture pin as shown in FIG. 3. It is apparent that the container can be either square as shown in the drawings or it may be round. The container may also have a calibration on one or both sides if desired. The container is made of a thermoplastic resinous material. The preferred material is polyethylene, polypropylene or mixtures thereof.

Although the principle utility of this container lies in the storing, handling and use of sterile liquids it is obvious that it can also be used in the storage, handling and use of liquids whose sterility is not required.

What is claimed is:

1. A blow-molded thermoplastic container for storing and dispensing liquids designed to be filled with said liquid during blow-molding comprising in combination a container having a body-portion, said body portion having a base portion, said body portion having a top portion, said top portion terminating in an elongated extending first neck, said neck terminating in a penetrable seal, said seal being contiguous with said neck and being formed during said blow-molding, a second relatively short neck extending outwardly from said body near substantially the base portion, said neck terminating in a penetrable seal, said seal being contiguous with said second neck and being formed during said blow-molding, a plug, said plug adapted and constructed to fit into a substantial portion of said second neck to thereby close any opening resulting when said seal of said second neck has been penetrated, a sealed depression in the body of said container adapted and constructed to frictionally retain said plug when said plug is not in use.

2. The container of claim 1 wherein the second neck extends outwardly from a depression in said body and said second neck terminates substantially flush with said body.

3. The container of claim 2 wherein the container contains a liquid.

4. The container of claim 1 wherein said container has a square configuration.

5. The container of claim 1 wherein said container has a round configuration.

6. The container of claim 1 wherein said thermoplastic is selected from the group consisting of polyethylene, polypropylene and mixtures thereof.

* * * * *